US005999146A

United States Patent [19]

Kanba et al.

[11] Patent Number: 5,999,146

[45] Date of Patent: Dec. 7, 1999

[54] ANTENNA DEVICE

[75] Inventors: Seiji Kanba, Otsu; Tsuyoshi Suesada, Omihachiman; Teruhisa Tsuru, Kameoka; Harufumi Mandai, Takatsuki, all of Japan

[73] Assignee: Murata Manufacturing Co., Ltd., Japan

[21] Appl. No.: 08/926,057

[22] Filed: Sep. 9, 1997

[30] Foreign Application Priority Data

Sep. 10, 1996 [JP] Japan ..... 8-239261
Mar. 17, 1997 [JP] Japan ..... 9-063028

[51] Int. Cl.[6] ..... H01Q 1/24

[52] U.S. Cl. ..... 343/895; 343/702; 343/700 MS; 343/846

[58] Field of Search ..... 343/895, 846, 343/700 MS, 787, 788, 702

[56] References Cited

U.S. PATENT DOCUMENTS 5,134,422 7/1992 Auriol ..... 343/895
5,541,610 7/1996 Imanishi et al. ..... 343/702
5,767,811 6/1998 Mandai et al. ..... 343/702
5,767,817 6/1998 Tsuru et al. ..... 343/895

FOREIGN PATENT DOCUMENTS 0320404 6/1989 European Pat. Off. .
0707355 4/1996 European Pat. Off. .
0762533 8/1996 European Pat. Off. .

*Primary Examiner*—Don Wong
*Assistant Examiner*—James Clinger
*Attorney, Agent, or Firm*—Ostrolenk, Faber, Gerb & Soffen, LLP

[57] ABSTRACT

A small-sized antenna device in which the conductor length can be reduced without encountering a reduction in gain. The antenna device is constructed by mounting a main antenna unit on a mounting substrate having a transmission line formed on the upper surface of the mounting substrate and also having a ground electrode formed on the back surface. One end of the transmission line is connected to a feeding terminal of the main antenna unit, and the other end of the transmission line is connected to a radio-frequency circuit of a radio communication device in which the antenna device is installed. The ground electrode is grounded.

17 Claims, 8 Drawing Sheets

ANTENNA DEVICE

BACKGROUND OF THE INVENTION

1. Field of the Invention

The present invention relates to an antenna device for use in a radio communication device such as a mobile radio communication system, local area network (LAN), etc.

2. Description of the Related Art

Linear antennas are known in the art. They include a dipole antenna having conductors with a total length of $\lambda/2$ (where $\lambda$ is the resonance wavelength) and a monopole antenna having a conductor with a length of $\lambda/4$. However, the disadvantage of these linear antennas is their large size. For example, $\lambda/4$ for an antenna with a resonance frequency of 1.9 GHz is about 4 cm. Such a large value of $\lambda/4$ results in a large size of the antenna and thus a large size of a mobile communication device.

To avoid the above problem, a dielectric dipole antenna 50 such as that shown in FIG. 10 has been proposed. The dielectric dipole antenna 50 comprises a conductor 52 formed on one principal surface of a dielectric 51 and a conductor 53 formed on the opposite principal surface of the dielectric 51 wherein one end of the conductor 52 extends across a side face of the dielectric 51 and is connected to a feeding terminal 54 formed on the opposite principal surface. One end of the conductor 53 is connected to an electrode 55 formed on the opposite principal surface of the dielectric 51. In this structure, resonance occurs between the conductors 52 and 53. Since the dielectric 51 serves to reduce the wavelength, it is possible to employ shorter conductors for the conductors 52 and 53, thus reducing the total size of the dielectric dipole antenna 50. The dielectric dipole antenna 50 is mounted, as shown in FIG. 11, on a mounting substrate 58 having a transmission line 56 formed on its upper surface and a ground electrode 57 formed on its back surface thereby constructing an antenna device 60. In this antenna device 60, one end of the transmission line 56 is connected to the feeding terminal 54 of the dielectric dipole antenna 50, and the other end of the transmission line 56 is connected to a radio-frequency circuit RF of a radio communication device on which the antenna device 60 is installed. The electrode 55 shown in FIG. 10 is connected to the ground electrode 57 via a via-hole (not shown).

However, in the conventional dielectric dipole antenna described above, although it is possible to reduce the size of the antenna by reducing the physical length of the conductors formed on the principal surfaces of the dielectric, the radiation area decreases with the reduction in the conductor length, and thus a corresponding reduction in the antenna gain occurs. This makes it difficult to reduce the size of the dielectric dipole antenna.

To solve the above problem, a principal object of the present invention is to provide a small-sized antenna device in which the conductor length can be reduced without encountering a reduction in gain.

SUMMARY OF THE INVENTION

To achieve the above object, the present invention provides an antenna device comprising a main antenna unit and a ground conductor, wherein the main antenna unit comprises: a base comprising at least one of a dielectric material and a magnetic material; at least one conductor formed at least one of on the surface of the base and inside the base; and at least one feeding terminal formed on the surface of the base so that a voltage is applied to the conductor via the feeding terminal; and the ground conductor comprises at least one of a ground electrode formed on a mounting substrate on which the main antenna unit is installed and the ground line of a transmission line via which the voltage is fed to the main antenna unit.

Preferably, the conductor of the main antenna unit is wound in a helical fashion in such a manner that the winding cross section of the conductor is substantially rectangular.

Alternatively, the conductor of the main antenna unit may be wound in a helical fashion in such a manner that the winding cross section of the conductor is substantially circular or elliptic.

In the antenna device according to the present invention, resonance occurs between the conductor of the main antenna unit and the ground conductor wherein the ground conductor serves as a part of the antenna conductor. This makes it possible to reduce the length of the conductor(s) of the main antenna unit while maintaining the radiation area within a sufficiently large range.

DETAILED DESCRIPTION OF EMBODIMENTS OF THE INVENTION

The antenna device according to the present invention is described in further detail below with reference to specific embodiments in conjunction with the accompanying drawings.

Figure 1A:
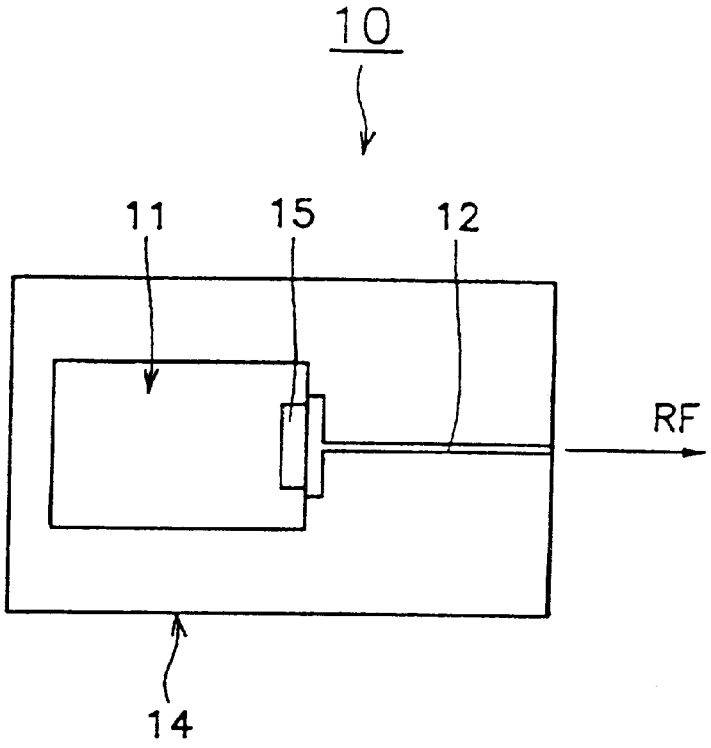
FIGS. 1(*a*) and 1(*b*) are top and bottom views, respectively, of an embodiment of an antenna device according to the present invention.
Figure 1B:
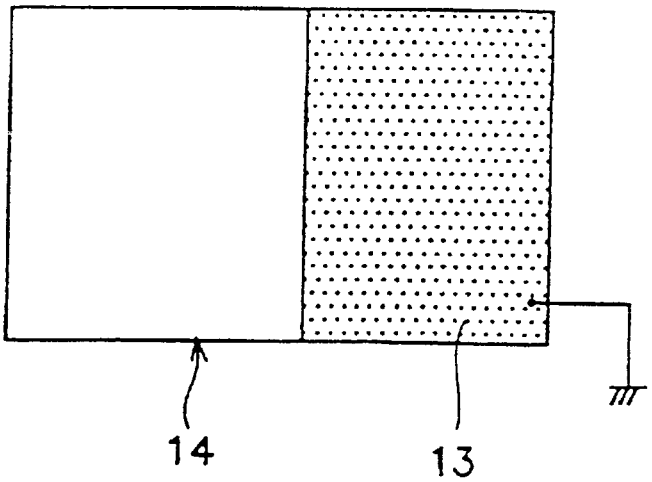

FIGS. 1(*a*) and 1(*b*) are top and bottom views of an embodiment of an antenna device according to the present invention. The antenna device 10 is constructed by mounting a main antenna unit 11 on a mounting substrate 14 having a transmission line 12 formed on its upper surface and a ground electrode 13 serving as a ground conductor formed on its back surface. In this antenna device 10, one end of the transmission line 12 is connected to the feeding terminal 15 of the main antenna unit 11, and the other end of the transmission line 12 is connected to the radio-frequency circuit RF of a radio communication device on which the antenna device 10 is installed. The ground electrode 13 is grounded.

Figure 2:
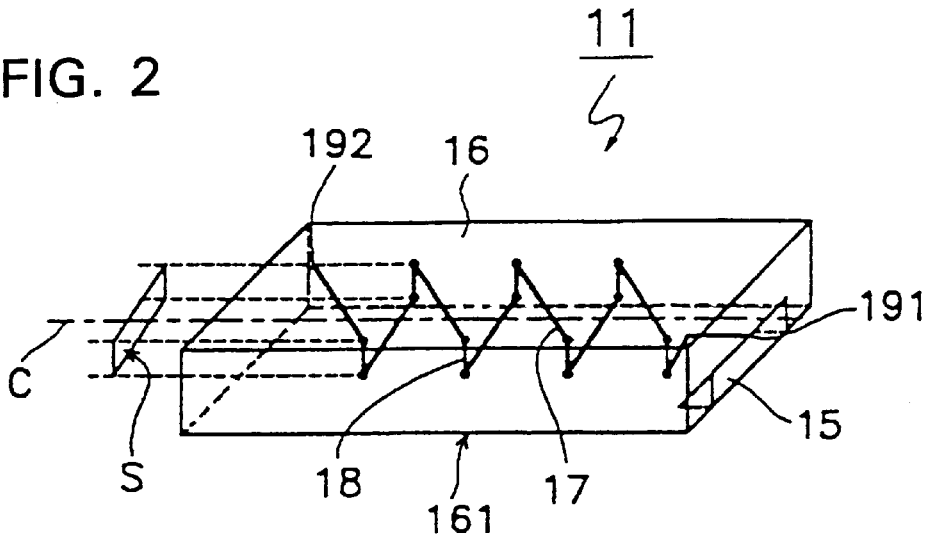
FIG. 2 is a perspective view illustrating the main antenna unit in the antenna device shown in FIG. 1.
Figure 3:
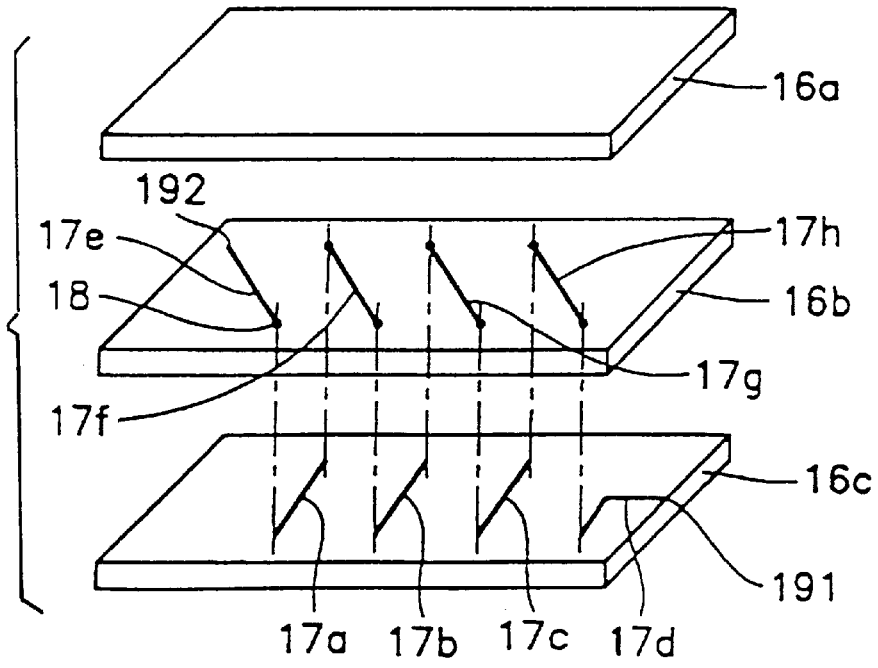
FIG. 3 is an exploded perspective view of the main antenna unit shown in FIG. 2.

The main antenna unit 11 comprises a rectangular base 16 having a mounting surface 161 and a conductor 17 disposed inside the base 16 wherein the conductor 17 is helically wound about a winding axis C extending in a longitudinal direction of the base 16 and parallel to the mounting surface 161, as shown in FIGS. 2 and 3. The base 16 comprises rectangular sheet layers 16*a*–16*c* made up of a dielectric material containing chiefly barium oxide, aluminum oxide, and silica, wherein the rectangular sheet layers 16*a*–16*c* are placed into a multilayer structure.

On the surface of sheet layers 16*b* and 16*c,* L-like or straight line shaped conductor patterns 17*a*–17*h* are formed of copper or a copper alloy by means of printing, evaporation, bonding, or plating. Via-holes 18 are formed in the sheet layer 16*b* in its thickness direction at predetermined locations (at one end of the conductor pattern 17*e* and at both ends of each conductor patterns 17*f*–17*h*).

After placing the sheet layers 16*a*–16*c* one on another into a multilayer structure, the base 16 and the conductor patterns 17*a*–17*h* are sintered into a single body. Then the conductor patterns 17*a*–17*h* are connected from one to another via the via-holes 18 thereby forming the conductor 17 inside the base 16 in such a manner that the conductor 17 is helically wound about the winding axis C extending in the longitudinal direction of the base 16 wherein the helically wound conductor 17 has a rectangular winding cross section S perpendicular to the winding axis C.

One end of the conductor 17 (one end of the pattern 17*d*) extends to the surface of the base 16 and is connected to a feeding terminal 15 formed on the surface of the base 16 thereby forming a feeding part 191 so that a voltage can be applied to the conductor 17 via the feeding terminal 15. The other end of the conductor 17 (an end of the conductor pattern 17*e*) is electrically open, thus forming an open end 192 inside the base 16.

Resonance occurs between the conductor 17 of the main antenna unit 11 and the ground electrode 13 formed on the back surface of the mounting substrate 14, wherein the resonance frequency is determined by the inductance and capacitance of the conductor 17 of the main antenna unit 11, the inductance and capacitance of the ground electrode 13 formed on the back surface of the mounting substrate 14, and the capacitance between the ground electrode 13 and the conductor 17.

In the above structure in which the conductor 17 is disposed inside the rectangular base 16 made up chiefly of barium oxide, aluminum oxide, and silica, a reduction in the propagation velocity occurs, which in turn causes a reduction in the wavelength. If the relative dielectric constant of the base 16 is given by $\epsilon$, the effective line length of the conductor 17 becomes $\epsilon^{1/2}$ times the physical length. Therefore, it is possible to achieve a greater effective line length than can be achieved by the conventional linear antenna having the same physical conductor length. This results in an increase in the current distribution area and thus an increase in radio wave radiation. Thus, an increase in the gain of the antenna device is achieved.

Figure 4:
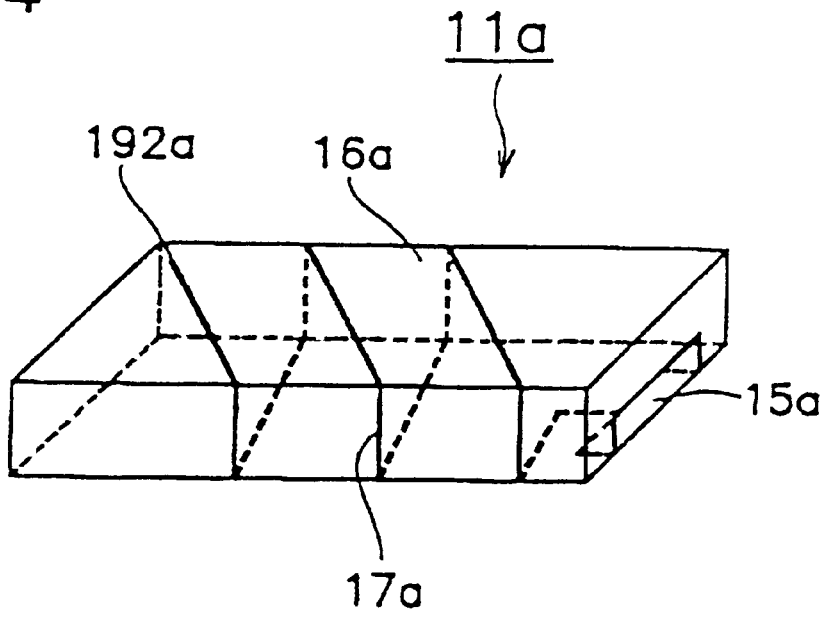
FIG. 4 is a perspective view illustrating a modification of the main antenna unit shown in FIG. 2.
Figure 5:
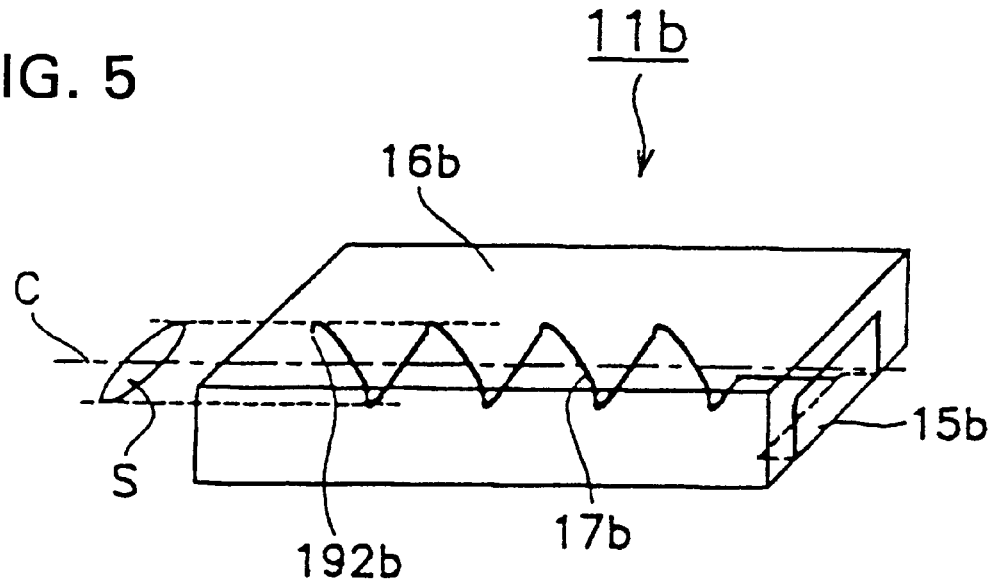
FIG. 5 is a perspective view illustrating another modification of the main antenna unit shown in FIG. 2.
Figure 6:
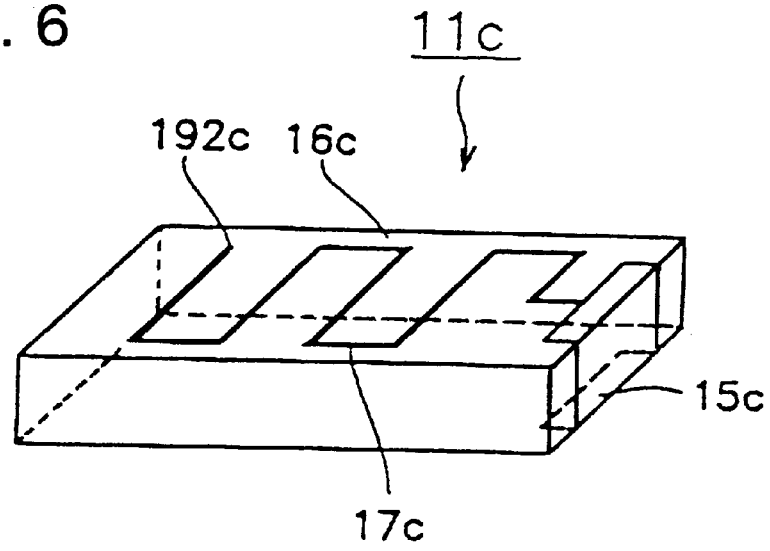
FIG. 6 is a perspective view illustrating still another modification of the main antenna unit shown in FIG. 2.
Figure 10:
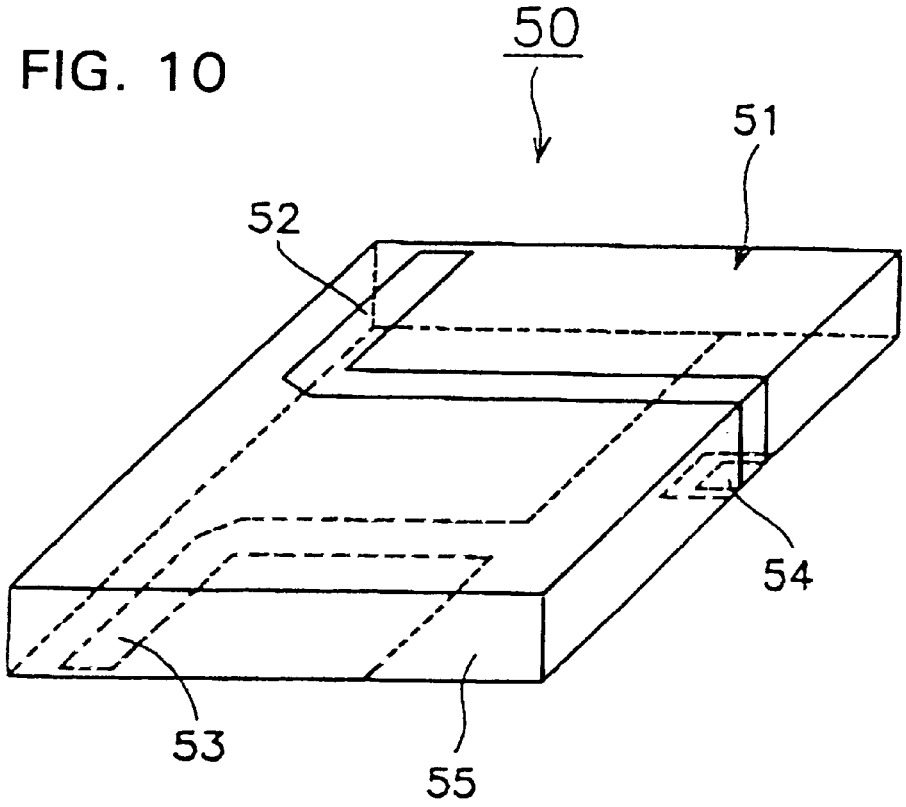
FIG. 10 is a perspective view of a conventional dielectric dipole antenna.

FIGS. 4–6 are perspective views illustrating modifications of the main antenna unit 11 shown in FIG. 2. The main antenna unit 11*a* shown in FIG. 4 comprises a rectangular base 16*a,* a conductor 17*a* helically wound in a longitudinal direction of the base 16*a,* and a feeding terminal 15*a* disposed on the surface of the base 16*a* so that a voltage can be applied to the conductor 17*a* via the feeding terminal 15*a*. One end of the conductor 17*a* is connected to the feeding terminal 15*a* on the surface of the base 16*a*. The other end of the conductor 17*a* is electrically open inside the base 16*a,* thus forming an open end 192*a*. The main antenna unit having the above structure can be realized by forming the helically wound conductor on the surface of the base by means of a simple process such as screen printing.

The main antenna unit 11*b* shown in FIG. 5 comprises: a rectangular base 16*b;* a conductor 17*b* formed inside the base 16*b* in such a manner that the conductor 17*b* is helically wound about a winding axis C extending in a longitudinal direction of the base 16*b* wherein the helically wound conductor 17*b* has a nearly elliptic winding cross section S perpendicular to the winding axis C; and a feeding terminal 15*b* formed on the surface of the base 16*b* so that a voltage can be applied to the conductor 17*b*. One end of the conductor 17*b* extends to the surface of the base 16*b* and is connected to the feeding terminal 15*b*. The other end of the conductor 17*b* is electrically open inside the base 16*b,* thus forming an open end 192*b*. In this main antenna unit, since the conductor is wound such that its winding cross section becomes substantially elliptic, there is no edge which would cause a loss as in the case where the winding cross section is substantially rectangular. Therefore, it is possible to reduce the total loss of the antenna device. The conductor may also be wound along the surface of the base so that its winding cross section becomes substantially elliptic.

The main antenna unit 11*c* shown in FIG. 6 comprises: a rectangular base 16*c;* a meander-shaped conductor 17*c* formed on the surface of the base 16*c;* and a feeding terminal 15*c* formed on the surface of the base 16*c* so that a voltage can be applied to the conductor 17*c* via the feeding terminal 15*c*. One end of the conductor 17*c* is connected to the feeding terminal 15*c* on the surface of the base 16*c*. The other end of the conductor 17*c* is electrically open so as to form an open end 192*c* on the surface of the base 16*c*. In this main antenna unit, since the meander-shaped conductor is formed on only one principal surface of the base, it is possible to reduce the thickness of the base and thus the total thickness of the main antenna unit. The meander-shaped conductor may also be formed inside the base.

Figure 7:
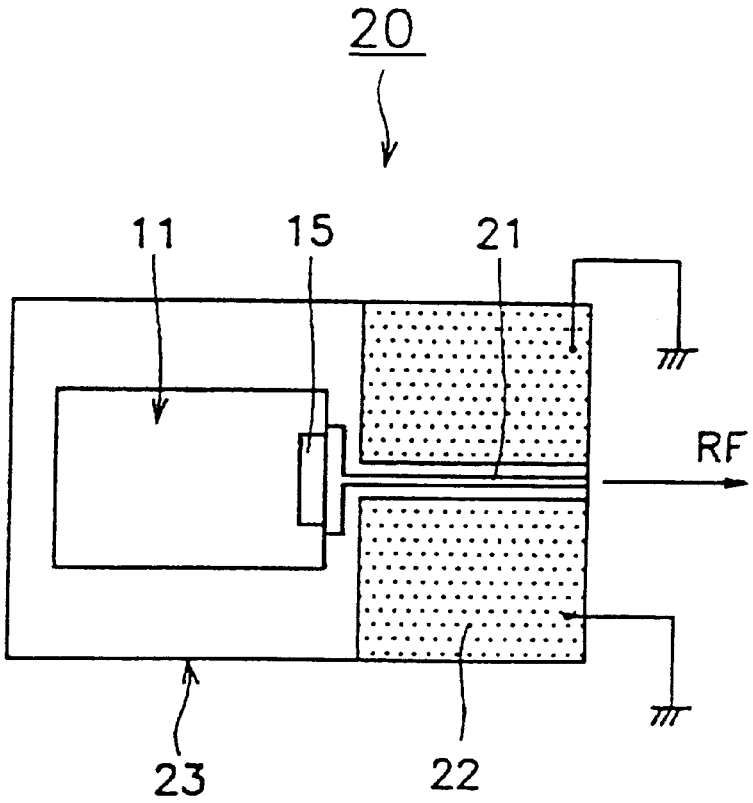
FIGS. 7(*a*) and 7(*b*) are top and bottom views, respectively, of a modification of the antenna device shown in FIG. 1.
Figure 7:
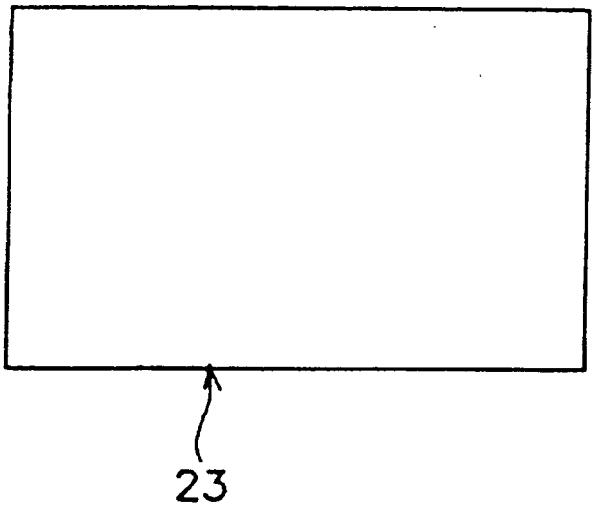

FIGS. 7(*a*) and 7(*b*) are top and bottom views of a modification of the antenna device shown in FIG. 1. The antenna device 20 is constructed by mounting a main antenna unit 11 on a mounting substrate 23 having a transmission line 21 and a ground electrode 22 serving as a ground conductor formed on the surface of the mounting substrate 23. In this antenna device 20, one end of the transmission line 21 is connected to the feeding terminal 15 of the main antenna unit 11, and the other end of the transmission line 21 is connected to the radio-frequency circuit RF of a radio communication device on which the antenna device 20 is installed. The ground electrode 22 is grounded.

This antenna device 20 is different from the antenna device 10 shown in FIG. 1 in that the ground electrode 22 serving as the ground conductor is formed on the upper surface of the mounting substrate 23.

Figure 8:
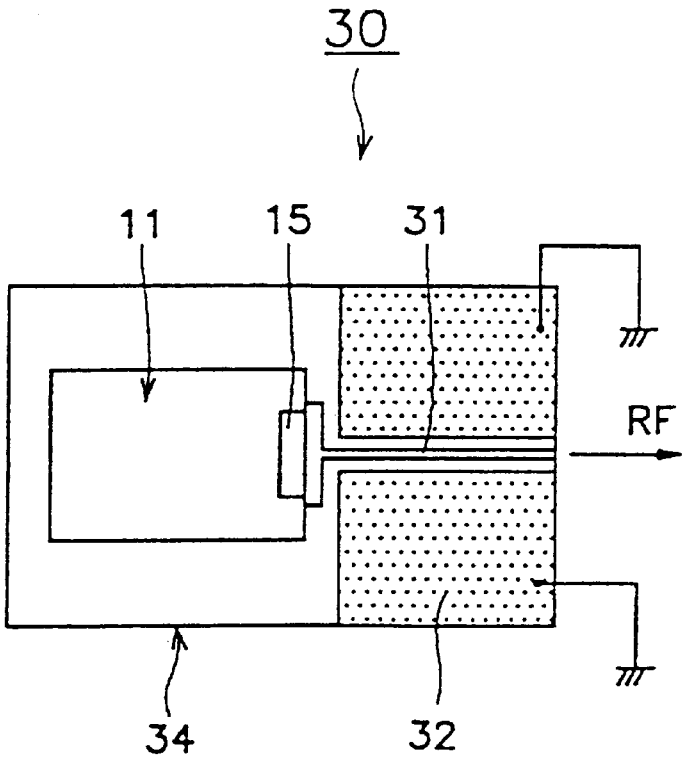
FIGS. 8(*a*) and 8(*b*) are top and bottom views, respectively, of another modification of the antenna device shown in FIG. 1.
Figure 8B:
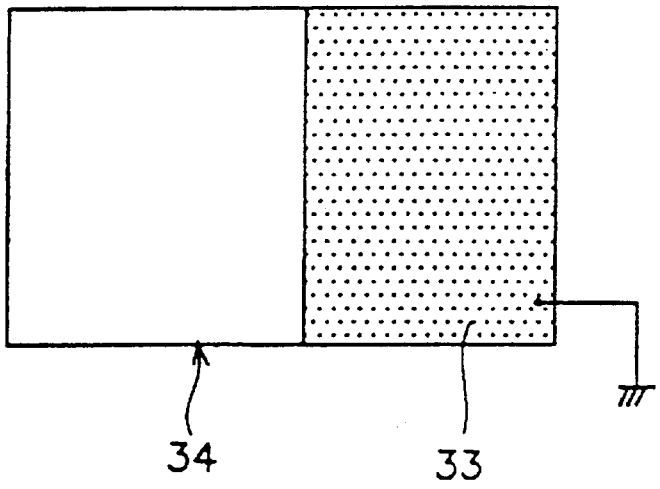

FIGS. 8(*a*) and 8(*b*) are top and bottom views illustrating another modification of the antenna device shown in FIG. 1. The antenna device 30 is constructed by mounting a main antenna unit 11 on a mounting substrate 34 having a transmission line 31 and a ground electrode 32 serving as a ground conductor formed on the upper surface of the mounting substrate 34 and also having a ground electrode 33 also serving as a ground conductor formed on the back surface of the mounting substrate 34. In this antenna device 30, one end of the transmission line 31 is connected to the feeding terminal 15 of the main antenna unit 11, and the other end of the transmission line 31 is connected to the radio-frequency circuit RF of a radio communication device on which the antenna device 30 is installed. The ground electrodes 32 and 33 are grounded. The ground electrodes 32 and 33 may be grounded separately or may be grounded in common via a via-hole (not shown) formed in the mounting substrate 34.

This antenna device 30 is different from the antenna device 10 shown in FIG. 1 in that the ground electrodes 32 and 33 serving as the ground conductor are formed so that one is formed on the upper surface and the other is formed on the back surface of the mounting substrate 34.

Figure 11A:
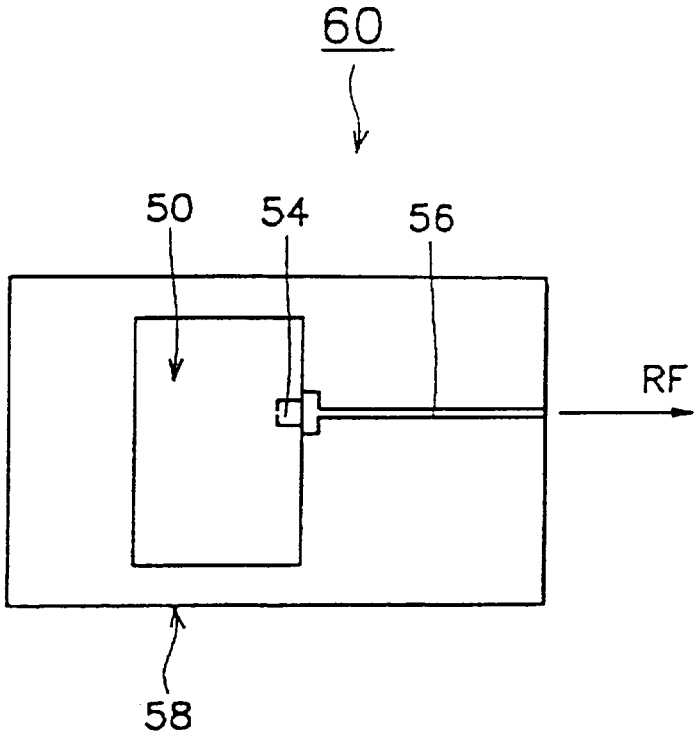
FIG. 11 is a perspective view of a conventional antenna device.
Figure 11B:
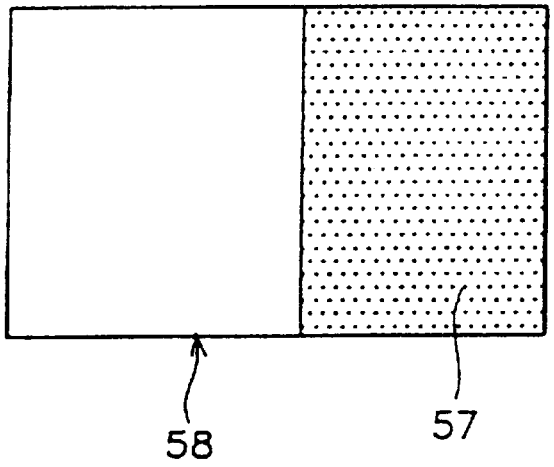

The gain was evaluated for the antenna device 10 shown in FIG. 1 and the conventional antenna device 60 shown in FIG. 11. The gain of the conventional antenna device 60 was −4.8 dB, and the gain of the antenna device 10 according to the present invention was 0.1 dB. The gain reduction of the conventional antenna device 60 is due to the fact that the radiation area decreases with the reduction in the size of the dielectric dipole antenna 50. In contrast, in the antenna device 10 according to the present invention, the ground electrode 13 acts as a part of the antenna, and thus no gain reduction occurs.

In the present embodiment, as described above, the antenna device includes the main antenna unit and the ground electrode serving as the ground conductor which serves as a part of the antenna, and thus the antenna device can maintain a sufficiently large radiation area. Therefore, it is possible to reduce the size of the antenna without encountering a reduction in the gain.

Because the size of the main antenna unit can be reduced, it can be mounted on a small mounting substrate. Therefore, it is possible to reduce the size of the mobile communication device having the antenna device.

If the conductor is wound so that it has a substantially rectangular winding cross section, it is possible to easily produce the main antenna unit by placing a plurality of sheet layers and sintering the base and the conductors into a single body.

Although in the above embodiments, the base of the main antenna unit is made up of a dielectric material containing chiefly barium oxide, aluminum oxide, and silica, the material for the base is not limited to the above dielectric. For example, dielectric materials containing chiefly titanium oxide and neodymium oxide, magnetic materials containing chiefly nickel, cobalt, and iron, or a mixture of such a dielectric material and a magnetic material may also be employed.

Furthermore, although in the above embodiments, the main antenna unit includes only one conductor, the main antenna unit may also include a plurality of conductors disposed in parallel to one another. In this case, the main antenna unit may have a plurality of resonance frequencies depending on the number of conductors. This allows a single antenna to accommodate a plurality of frequency bands.

Furthermore, instead of forming the conductor either inside the base of the main antenna unit or on the surface of the base as in the above embodiments, the wound conductor may be disposed both on the surface of and in the inside of the base.

Furthermore, although in the above embodiments, the ground conductor serving as a part of the antenna is realized by the ground electrode formed on the mounting substrate on which the main antenna unit is mounted, the ground line of the transmission line, which is used to connect the antenna device 40 to the radio-frequency circuit RF of a radio communication device on which the antenna device is installed, may also serve as a part of the antenna.

Figure 9A:
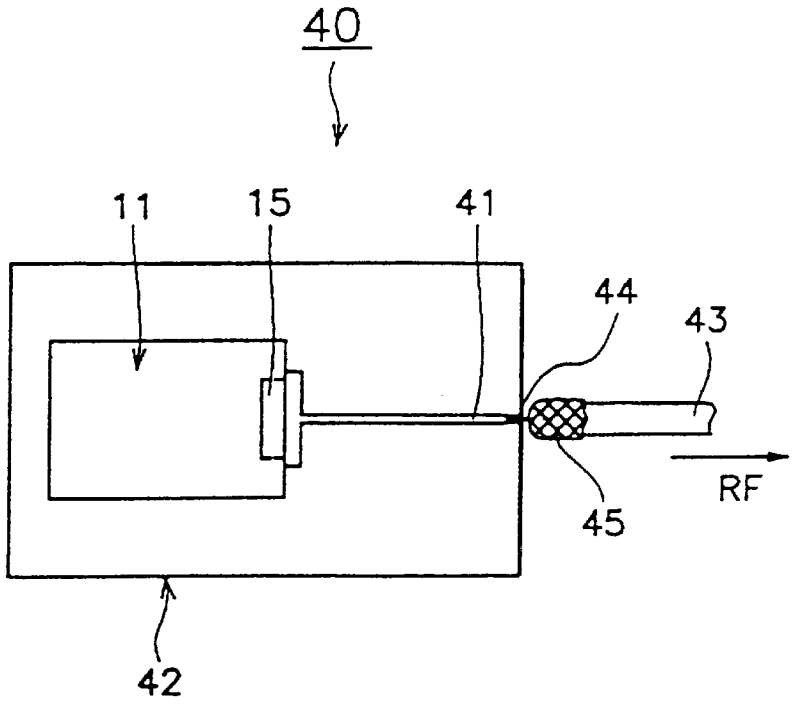
FIG. 9 is a perspective view of another embodiment of an antenna device according to the present invention.
Figure 9B:
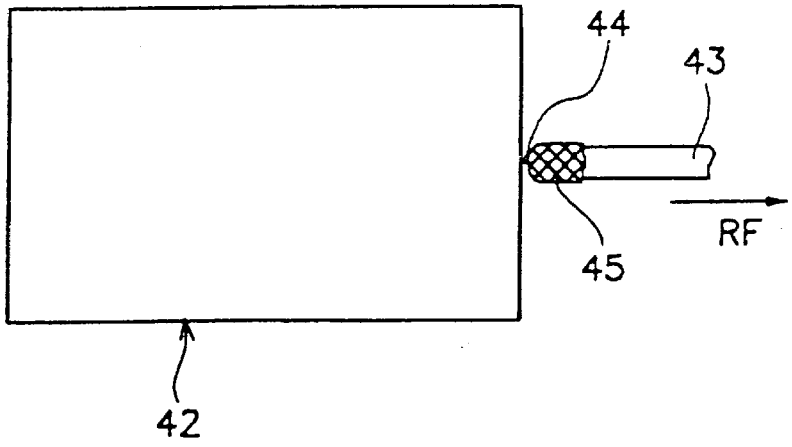

In this antenna device 40, as shown in FIGS. 9(*a*) and (*b*), a main antenna unit 11 is mounted on a mounting substrate 42 having a transmission line 41 formed on the surface of the mounting substrate 42. One end of the transmission line 41 is connected to a feeding terminal 15 of the main unit 11, and the other end of the transmission line 41 is connected via solder to the central conductor 44 of a transmission line such as a coaxial feeder 43 used to connect the antenna device 40 to a radio-frequency circuit RF of a radio communication device on which the antenna device 40 is installed. In this case, the outer conductor serving as the ground line 45 of the coaxial feeder 43 acts as a part of the antenna, and thus this antenna device also has similar advantages to those of the antenna device 10 shown in FIG. 1.

The structure employed in any antenna device 10, 20, or 30 shown in FIG. 1, 7, or 8 may be combined with the structure employed in the antenna device 40 shown in FIG. 9 in such a manner that both the ground electrode formed on the mounting substrate and the ground line of the transmission line act as a part of the antenna. In this case, a further increase in the radiation area is achieved, and therefore it is possible to further reduce the size of the main antenna unit and thus the size of the antenna device. This allows a further reduction in the size of the radio communication device containing the antenna device.

Although in the antenna devices 10 and 30 shown in FIGS. 1 and 8, the ground electrode 13 or 33 serving as the ground conductor is formed on a particular part of the back surface of the mounting substrate 14 or 34, the ground electrode 13 or 33 may be formed on any portion of the back surface of the mounting substrate 14 or 34 as long as the ground electrode 13 or 33 together with the transmission line 12 or 31 acts as a microstrip structure.

Furthermore, although in the antenna devices 20 and 30 shown in FIGS. 7 and 8, the ground electrode 22 or 32 serving as the ground conductor is formed on a particular part of the upper surface of the mounting substrate 23 or 34, the ground electrode 22 or 32 may be formed on any portion of the upper surface of the mounting substrate 23 or 34 as long as the ground electrode 22 or 32 is electrically isolated from the transmission line 12 or 31 and the ground electrode 22 or 32 together with the transmission line 12 or 31 acts as a coplanar structure.

In the antenna device according to an aspect of the present invention, the antenna device is constructed with the main antenna unit and the ground conductor so that the ground conductor acts as a part of the antenna thereby obtaining a sufficiently large radiation area. Therefore, it is possible to reduce the size of the antenna without encountering a reduction in the gain.

Since the main antenna unit having a reduced size can be mounted on a mounting substrate having a reduced size, it is possible to achieve a reduction in the size of a mobile communication device in which the antenna device is installed.

In the antenna device in another aspect of the present invention, the conductor of the main antenna unit is helically wound so that it has a substantially rectangular winding cross section. The main antenna unit having such a structure can be easily produced by placing a plurality of sheet layers and sintering the base and the conductor into a single body.

In the antenna device according to still another aspect of the present invention, the conductor of the main antenna unit is helically wound so that it has a substantially circular or elliptic winding cross section whereby there is no edge which would cause a loss as in the case where the winding cross section is substantially rectangular. This allows a reduction in the total loss of the antenna device.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An antenna device comprising a main antenna unit and a ground conductor, wherein:

said main antenna unit comprises: a base comprising at least one of a dielectric material and a magnetic material; at least one conductor formed at least one of on a surface of the base and inside said base; and at least one feeding terminal formed on the surface of said base so that a voltage is applied to said conductor via said feeding terminal;

said ground conductor comprises at least one of a ground electrode formed on a mounting substrate on which said main antenna unit is mounted and a ground line of a transmission line via which the voltage is fed to said main antenna unit and further wherein the base comprises a plurality of layers with at least one portion of the conductor on at least two of said layers, at least one via hole being provided on at least one of the layers, the layers being laminated together to form the base and the portions of the conductor being connected together by said at least one via hole when the layers are laminated together, the conductor comprising a helical conductor having a helix axis, the helix axis being perpendicular to a direction of thickness of the plurality of layers.

2. The antenna device of claim 1, wherein the conductor of said main antenna unit is wound helically and the winding cross section of said conductor is substantially rectangular.

3. The antenna device of claim 1, wherein the conductor of said main antenna unit is wound helically and the winding cross section of said conductor is substantially circular or elliptic.

4. The antenna device of claim 1, wherein the ground electrode is formed on a surface of the mounting substrate on which the main antenna unit is disposed.

5. The antenna device of claim 1, wherein the ground electrode is formed on a surface of the mounting substrate opposite the surface on which the main antenna unit is disposed.

6. The antenna device of claim 1, wherein the ground electrode is formed on two opposed surfaces of the mounting substrate.

7. The antenna device of claim 1, wherein the conductor is disposed inside the substrate.

8. The antenna device of claim 1, wherein the conductor is disposed on the surface of the substrate.

9. The antenna device of claim 1, wherein the conductor comprises a planar meander shaped conductor.

10. The antenna device of claim 1, wherein the conductor terminates in a free end at least one of inside tha base and on the surface of the base.

11. The antenna device of claim 1, wherein the transmission line is disposed on a surface of the substrate and the ground electrode is disposed on the surface of the substrate on either side of the transmission line.

12. The antenna device of claim 1, wherein the ground electrode and the transmission line are disposed on the same surface of the substrate.

13. The antenna device of claim 1, wherein the meander shaped conductor is disposed on a surface of the base.

14. The antenna device of claim 1, wherein the base comprises a dielectric material comprising barium oxide, aluminum oxide and silica.

15. The antenna device of claim 1, wherein the base comprises a dielectric material comprising titanium oxide and neodymium oxide.

16. The antenna device of claim 1, wherein the base comprises a dielectric material comprising nickel, cobalt and iron.

17. The antenna device of claim 1, wherein the base comprises a combination of a dielectric material and a magnetic material.

* * * * *